US009017503B2

(12) United States Patent
Zhang et al.

(10) Patent No.: US 9,017,503 B2
(45) Date of Patent: Apr. 28, 2015

(54) METHOD FOR MAKING CARBON NANOTUBE PAPER

(75) Inventors: Ling Zhang, Beijing (CN); Chang-Hong Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 323 days.

(21) Appl. No.: 13/589,755

(22) Filed: Aug. 20, 2012

(65) Prior Publication Data

US 2013/0160933 A1 Jun. 27, 2013

(30) Foreign Application Priority Data

Dec. 21, 2011 (CN) ..... 2011 1 0433695

(51) Int. Cl.
*B82Y 40/00* (2011.01)
*D04H 1/4242* (2012.01)

(52) U.S. Cl.
CPC ..... *D04H 1/4242* (2013.01)

(58) Field of Classification Search
USPC ..... 156/184, 192, 194
See application file for complete search history.

(56) References Cited

U.S. PATENT DOCUMENTS

| | | | | |
|---|---|---|---|---|
| 8,431,066 | B2 * | 4/2013 | Liu | 264/482 |
| 2004/0053053 | A1 | 3/2004 | Jiang et al. | |
| 2006/0062944 | A1 | 3/2006 | Gardner et al. | |
| 2007/0000642 | A1 | 1/2007 | Yamazaki et al. | |
| 2008/0299031 | A1 * | 12/2008 | Liu et al. | 423/447.3 |
| 2009/0181239 | A1 | 7/2009 | Fan et al. | |
| 2010/0308489 | A1 | 12/2010 | Feng et al. | |
| 2010/0310809 | A1 | 12/2010 | Jiang et al. | |
| 2011/0262772 | A1 * | 10/2011 | Hauge et al. | 428/688 |
| 2011/0300031 | A1 | 12/2011 | Kim et al. | |

FOREIGN PATENT DOCUMENTS

| | | |
|---|---|---|
| CN | 101480858 | 7/2009 |
| CN | 101905878 | 12/2010 |
| CN | 102180460 | 9/2011 |
| TW | I265612 | 11/2006 |
| TW | I306116 | 2/2009 |
| TW | 200909342 | 3/2009 |
| TW | I309461 | 5/2009 |

* cited by examiner

*Primary Examiner* — Jeff Aftergut
(74) *Attorney, Agent, or Firm* — Novak Druce Connolly Bove + Quigg LLP

(57) ABSTRACT

A method for making carbon nanotube paper is disclosed. The method includes using a roller, a pressing device, and at least one carbon nanotube array. At least one carbon nanotube film structure is formed by drawing a plurality of carbon nanotubes from the at least one carbon nanotube array. The at least one carbon nanotube film structure is wound onto the roller. The carbon nanotube paper is formed by pressing the at least one carbon nanotube film structure using the pressing device.

20 Claims, 15 Drawing Sheets

METHOD FOR MAKING CARBON NANOTUBE PAPER

CROSS-REFERENCE TO RELATED APPLICATIONS

This application claims all benefits accruing under 35 U.S.C. §119 from China Patent Application No. 201110433695.9, filed on Dec. 21, 2011, in the China Intellectual Property Office. This application is also related to applications entitled, "HEAT-DISSIPATION STRUCTURE AND ELECTRONIC DEVICE USING THE SAME", filed Aug. 20, 2012 Ser. No. 13/589,733 and "HEAT-DISSIPATION STRUCTURE AND ELECTRONIC DEVICE USING THE SAME", filed Aug. 20, 2012 Ser. No. 13/589,742. The disclosures of the above-identified applications are incorporated herein by reference.

BACKGROUND

1. Technical Field

The present disclosure relates to methods for making carbon nanotube paper and, more particularly, to a method for making high-density, oriented carbon nanotube paper.

2. Description of Related Art

Generally, carbon nanotubes prepared by conventional methods are in particle or powder forms. The particle or powder-formed carbon nanotubes limit the applications of the carbon nanotubes. Thus, the carbon nanotubes need to form meso- or macro-scale structures for practical applications in various fields.

The carbon nanotube paper is a macro-scale structure which retains the excellent physical properties of carbon nanotubes. Therefore, it has great potential applications in heat-dissipation structures, electrical-conducting structures and thermal-conducting structures.

Generally, the carbon nanotube paper is made by wet method, which mainly includes modification, dispersion, filtration, and drying to form the carbon nanotube paper. An example is shown and discussed in U.S. Publication. No. 20110300031A1, entitled, "MANUFACTURING CARBON NANOTUBE PAPER," published to Kim, et al. on Dec. 8, 2011. This patent application discloses an apparatus for making carbon nanotube paper and a method for making carbon nanotube paper using the apparatus. The method in this publication includes preparing carbon nanotube colloidal solution, preparing structure having relatively sharp edge, immersing structure into carbon nanotube colloidal solution, and withdrawing structure from carbon nanotube colloidal solution.

However, the orientation of carbon nanotubes in the carbon nanotube paper made by the method is undefined, and the carbon nanotube paper is disordered, due to the evenly dispersion of the carbon nanotubes into solvent. Additionally, the density of carbon nanotubes in the carbon nanotube paper is low, which affects the mechanical and conducting properties of the carbon nanotube paper.

What is needed, therefore, is to provide a method for making carbon nanotube paper that has a high density and is directional.

BRIEF DESCRIPTION OF THE DRAWINGS

Many aspects of the present disclosure can be better understood with reference to the following drawings. The components in the drawings are not necessarily to scale, the emphasis instead being placed upon clearly illustrating the principles of the present embodiments.

DETAILED DESCRIPTION

Figure 1:
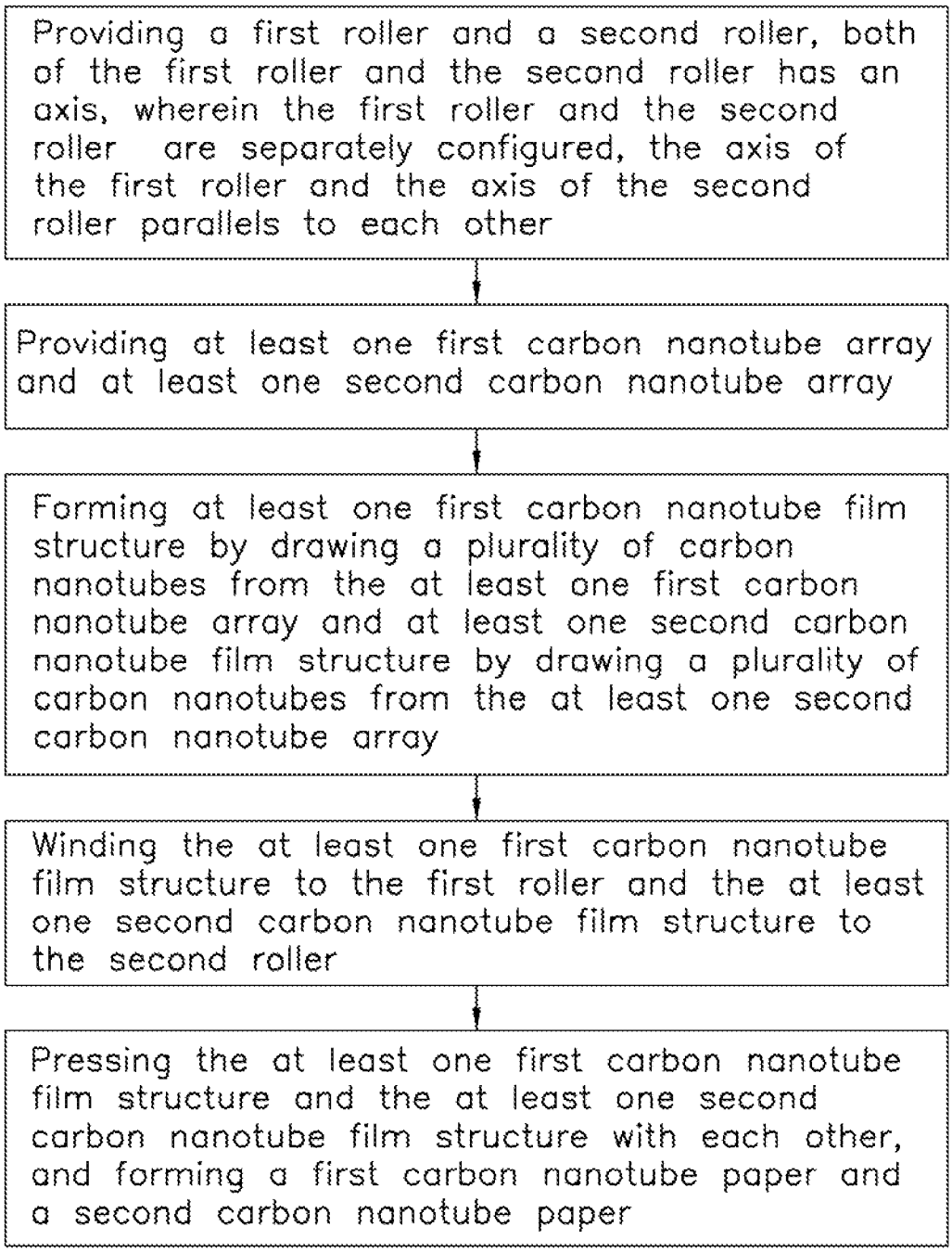
FIG. 1 is a flowchart of a method for making carbon nanotube paper according to one embodiment.
Figure 2A:
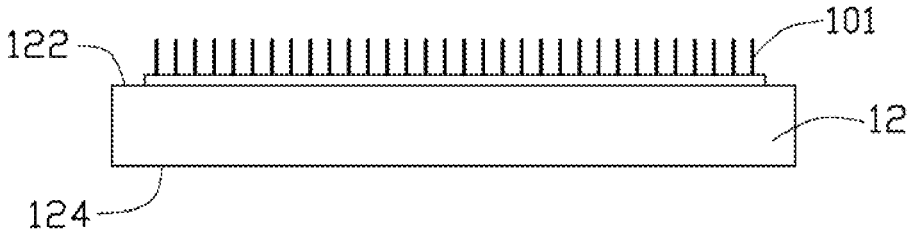
FIG. 2A is a schematic diagram of a substrate with a first carbon nanotube array according to one embodiment.
Figure 2B:
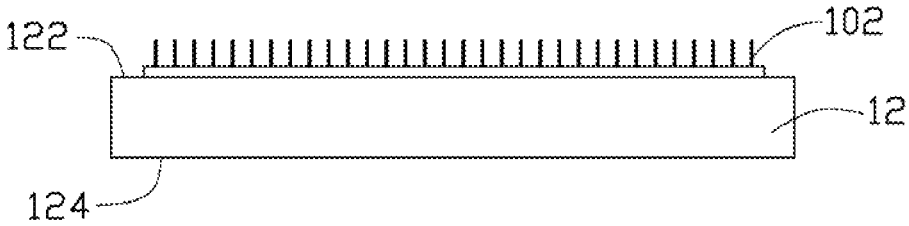
FIG. 2B is a schematic diagram of a substrate with a second carbon nanotube array according to one embodiment.
Figure 3:
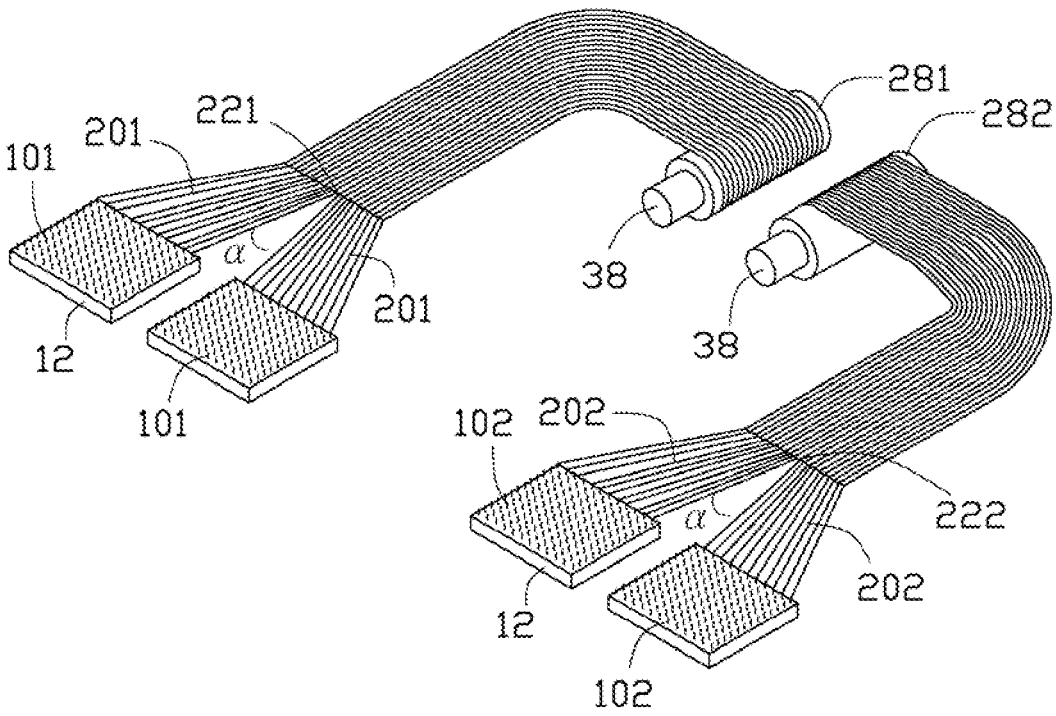
FIG. 3 is a schematic diagram of a method for making carbon nanotube paper according to one embodiment.

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean at least one.

Carbon nanotubes may be assembled to form carbon nanotube papers, sheets, wraps, or films having a two-dimensional structure and improved mechanical, electrical and chemical characteristics. Carbon nanotube papers may be used in various applications, such as armor, sensors, diodes, polarized light sources, heat sinks, etc.

Referring to FIG. 1, FIG. 2A, FIG. 2B and FIG. 3, a method for making a carbon nanotube paper of one embodiment includes following steps:

(S1), providing a first roller 281 and a second roller 282, wherein each of the first roller 281 and the second roller 282 has an axis, the first roller 281 and the second roller 282 are separately configured, and the axis of the first roller 281 and the axis of the second roller 282 are parallel to each other;

(S2), providing at least one first carbon nanotube array 101 and at least one second carbon nanotube array 102;

(S3), forming at least one first carbon nanotube film structure 201 by drawing a plurality of carbon nanotubes from the at least one first carbon nanotube array 101, and forming at least one second carbon nanotube film structure 202 by drawing a plurality of carbon nanotubes from the at least one second carbon nanotube array 102;

(S4), winding the at least one first carbon nanotube film structure 201 onto the first roller 281, and winding the at least one second carbon nanotube film structure 202 onto the second roller 282; and (S5), pressing the at least one first carbon nanotube film structure 201 and the at least one second carbon nanotube film structure 202 with each other, and forming a first carbon nanotube paper and a second carbon nanotube paper.

In step (S1), the first roller 281 and the second roller 282 can both be cylinders and can be made of various solid materials, such as glasses, metals, polymers and ceramics. In one embodiment, both of the first roller 281 and the second roller 282 are made of organic glass. The first roller 281 and the second roller 282 can be fixed on two different motors 38, respectively. The rolling directions of the first roller 281 and the second roller 282 can be same or different. In one embodiment, the rolling direction of the first roller 281 is clockwise, while the second roller 282 is counterclockwise. The distance between the first roller 281 and the second roller 282 can range from about 30 microns to about 130 microns.

In step (S2), the number of the at least one first carbon nanotube array 101 and the number of the at least one second carbon nanotube array 102 are both unrestricted. In one embodiment, the number of the at least one first carbon nanotube array 101 is 2. The number of the at least one second carbon nanotube array 102 is 2. Each of the two first carbon nanotube arrays 101 and two second carbon nanotube arrays 102 is formed on a substrate 12. Therefore, there are four substrates 12 used in one embodiment. Each of the substrates 12 has a first surface 122 and a second surface 124 opposing the first surface 122. The substrates 12 can be coplanar. The substrates 12 can be arranged, for example, in a straight line, a curved line, or a zigzag. In one embodiment, the two first carbon nanotube arrays 101 are arranged near the first roller 281, and the two second carbon nanotube arrays 102 are arranged near the second roller 282. The two first carbon nanotube arrays 101 and two second carbon nanotube arrays 102 are arranged in a straight line.

The two first carbon nanotube arrays 101 and the two second carbon nanotube arrays 102 can have a same structure and are composed of a plurality of carbon nanotubes. The plurality of carbon nanotubes can be single-walled carbon nanotubes with diameters of about 0.5 nanometers to about 50 nanometers, double-walled nanotubes with diameters of about 1 nanometer to about 50 nanometers, multi-walled carbon nanotubes with diameters of about 1.5 nanometers to about 50 nanometers, or any combination thereof. In one embodiment, the plurality of carbon nanotubes are multi-walled carbon nanotubes, and substantially parallel to each other. Each of the two first carbon nanotube arrays 101 and the two second carbon nanotube arrays 102 is essentially free of impurities, such as carbonaceous or residual catalyst particles. Each of the two first carbon nanotube arrays 101 and the two second carbon nanotube arrays 102 can be a super-aligned carbon nanotube array as described in U.S. Publication. No. 20040053053A1, entitled "CARBON NANOTUBE ARRAY AND METHOD FOR FORMING SAME," published to Jiang, et al. on Mar. 18, 2004. The method for making the two first carbon nanotube arrays 101 and the two second carbon nanotube arrays 102 is unrestricted, and can be chemical vapor deposition method or other methods.

In step (S3), a method for making the at least one first carbon nanotube film structure 201 includes following steps:

(S31), providing a drawing tool;

(S32), contacting the drawing tool to the plurality of carbon nanotubes of the at least one first carbon nanotube array 101; and (S33), drawing the plurality of carbon nanotubes by the drawing tool along a drawing direction to form the at least one first carbon nanotube film structure 201.

In step (S33), the drawing direction is away from the at least one first carbon nanotube array 101. A first angle can be defined between the drawing direction and the first surface 122 of one of the at least two substrates 12. The first angle can be range from about 0 degrees to about 30 degrees. In one embodiment, the first angle can range from about 0 degrees to about 5 degrees. During the drawing process, as the plurality of carbon nanotubes contacting the drawing tool are drawn out, other carbon nanotubes are also drawn out end to end due to the van der Waals attractive force between ends of adjacent carbon nanotubes. The carbon nanotubes in the at least one first carbon nanotube film structure 201 are substantially parallel to the drawing directions. In one embodiment, the drawing tool is an adhesive tape having a certain width. The width of the adhesive tape can be a little more than the plurality of carbon nanotubes contacting the drawing tool, with the first angle at about 5 degrees.

The at least one second carbon nanotube film structure 202 can be made by the same method of the at least one first carbon nanotube film structure 201. In one embodiment, two first carbon nanotube film structures 201 and two second carbon nanotube film structures 202 are obtained.

In step (S3), while drawing films from the at least one first carbon nanotube array 101, ensure that the drawing direction is from each of the at least one first carbon nanotube array 101 toward a first spot 221, and while drawing films from the at least one second carbon nanotube array 102, ensure that the drawing direction is from each of the at least one second carbon nanotube array 102 toward a second spot 222. In one embodiment, one first carbon nanotube film structure 201 and one second carbon nanotube film structure 202 are formed, and the first carbon nanotube film structure 201 passes the first spot 221 and the second carbon nanotube film structure 202 passes the second spot 222. In one embodiment, more than one first carbon nanotube film structure 201 and more than one second carbon nanotube film structure 202 are formed, and each of the first carbon nanotube film structures 201 converges at the first spot 221 and each of the second carbon nanotube film structures 202 converges at the second spot 222. In one embodiment, more than two first carbon nanotube film structures 201 and more than two second carbon nanotube film structures 202 are formed, and there can be more than one first spot 221 and more than one second spot 222. Some of the first carbon nanotube film structures 201 converge at one first spot 221 and then converge at another first spot 221 with the other first carbon nanotube structures 201. Some of the second carbon nanotube film structures 202 converge at one second spot 222 and then converge at another second spot 222 with the other second carbon nanotube structures 202. The more than one first carbon nanotube film structure 201 can adhesive together at the spot 221 due to the high adhesiveness of the first carbon nanotube film structures 201. The more than one second carbon nanotube film structure 202 can adhesive together at the spot 222 due to the high adhesiveness of the second carbon nanotube film structures 202. There is an angle $\alpha$ at the spot 221 or the spot 222 between each two adjacent first carbon nanotube film structures 201 or each two adjacent second carbon nanotube film structures 202. The angle $\alpha$ can be in a range from about 0 degrees to about 180 degrees. In one embodiment, the angle $\alpha$ is greater than 0 degrees and up to less than or equal to 60 degrees. In one embodiment, the angle $\alpha$ is about 60 degrees.

In step (S4), the at least one first carbon nanotube film structure 201 can be wound onto the first roller 281 by tweezers, clips or other tools, and the first roller 281 is rolled at a predetermined speed to make sure that the at least one first carbon nanotube film structure 201 is continuously wound onto the first roller 281. Similarly, the at least one second carbon nanotube film structure 202 is wound onto the second roller 282, by tweezers, clips or other tools, and the second roller 282 is rolled at a predetermined speed to make sure that the at least one second carbon nanotube film structure 202 is continuously wound onto the second roller 282.

As the winding process continues, the at least one first carbon nanotube film structure 201 on the first roller 281 and the at least one second carbon nanotube film structure 202 on the second roller 282 accumulates layer by layer. Thus, the distance between the at least one first carbon nanotube film structure 201 on the first roller 281 and the at least one second carbon nanotube film structure 202 on the second roller 282 becomes closer and closer and finally they contact to each other.

In step (S5), as the winding process continues, the at least one first carbon nanotube film structure 201 on the first roller 281 and the at least one second carbon nanotube film structure 202 on the second roller 282 grind or press with each other. As the thickness of carbon nanotube film structures on the rollers becomes thicker, the pressing or grinding force becomes stronger. Finally, the first at least one carbon nanotube film structure 201 and the at least one second carbon nanotube film structure 202 are both compacted. Thus, a high-density, oriented first carbon nanotube paper and a second carbon nanotube paper are obtained. In application, the first carbon nanotube paper and the second carbon nanotube paper can be sheared from the first roller 281 and the second roller 282, and cut into different size and shape to be applied in various devices.

The width of the first carbon nanotube paper substantially equals to the width of the at least one first carbon nanotube film structure 201, which relates to the size and numbers of the first carbon nanotube array 101. Similarly, the width of the second carbon nanotube paper substantially equals to the width of the at least one second carbon nanotube film structure 202, which relates to the size and numbers of the second carbon nanotube array 102. The density of the first carbon nanotube paper and the second carbon nanotube paper are determined by the line density of the at least one first carbon nanotube film structure 201 and the at least one second carbon nanotube film structure 202, the distance between the first roller 281 and the second roller 282, and the pressing force between the at least one first carbon nanotube film structure 201 and the at least one second carbon nanotube film structure 202. As mentioned, the line density refers to the number of carbon nanotubes on the roller per millimeters. The line density of the at least one first carbon nanotube film structure 201 and the at least one second carbon nanotube film structure 202 are both more than 10 per millimeters. In one embodiment, the line density of the at least one first carbon nanotube film structure 201 and the at least one second carbon nanotube film structure 202 are both more than 80 per millimeters. The distance between the first roller 281 and the second roller 282 can range from about 30 microns to about 130 microns. The pressing force between the at least one first carbon nanotube film structure 201 and the at least one second carbon nanotube film structure 202 can range from about 20 MPa to about 40 MPa. The density of the first carbon nanotube paper and the second carbon nanotube paper are both equal to or more than 0.3 g/cm$^3$ and can be up to 1.4 g/cm$^3$, which is much higher than the density of the first carbon nanotube film structure 201 and the second carbon nanotube film structure 202. In one embodiment, the density of the first carbon nanotube paper and the second carbon nanotube paper are both equal to or more than 0.5 g/cm$^3$ and can be up to 1.2 g/cm$^3$. In one embodiment, the line density of the at least one first carbon nanotube film structure 201 and the at least one second carbon nanotube film structure 202 are both 80 per millimeters, while the distance between the first roller 281 and the second roller 282 is set to from 70 microns to 90 microns, and the density of the first carbon nanotube paper and the second carbon nanotube paper acquired are both between 0.8 g/cm$^3$ and 0.9 g/cm$^3$. In another embodiment, the line density of the at least one first carbon nanotube film structure 201 and the at least one second carbon nanotube film structure 202 are both 80 per millimeters, while the distance between the first roller 281 and the second roller 282 is 100 microns, and the density of the first carbon nanotube paper and the second carbon nanotube paper acquired are both 1.2 g/cm$^3$. In another embodiment, the line density of the at least one first carbon nanotube film structure 201 and the at least one second carbon nanotube film structure 202 are both 80 per millimeters, while the distance between the first roller 281 and the second roller 282 is set to 120 microns to 130 microns, and the density of the first carbon nanotube paper and the second carbon nanotube paper acquired are both 1.4 g/cm$^3$.

It is to be understood that the process for making the first carbon nanotube paper and the second carbon nanotube paper can be a continuous process for as long as carbon nanotubes are available on the array(s).

Figure 4:
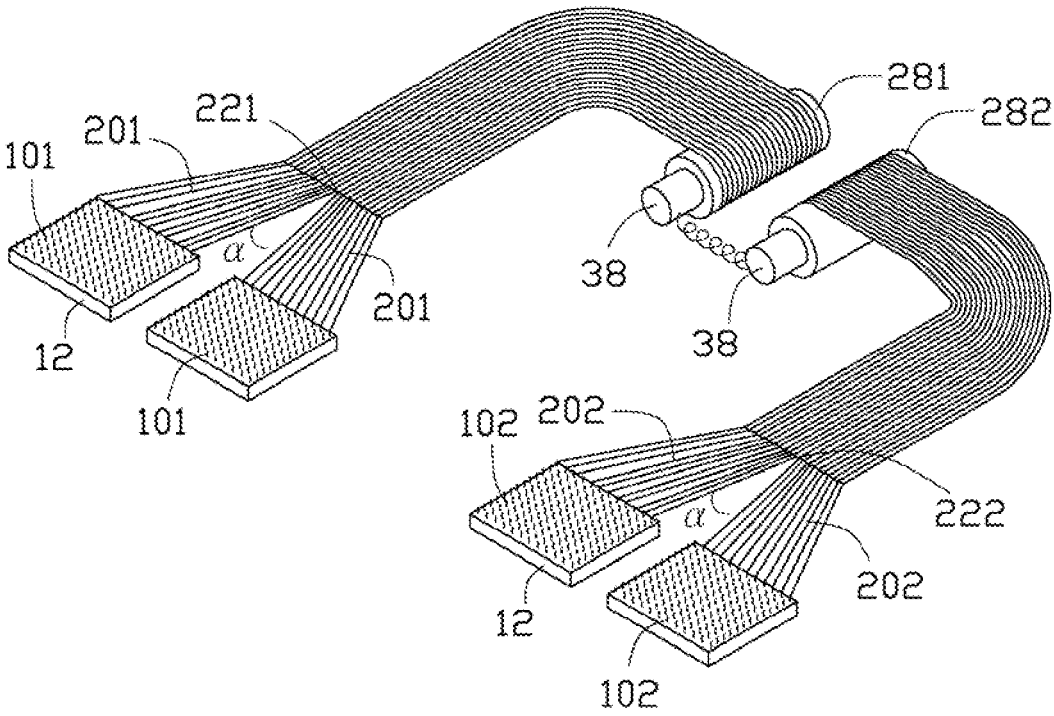
FIG. 4 is a schematic diagram of another method for making carbon nanotube paper according to one embodiment.

Referring to FIG. 4, in one embodiment, an elastic element such as a spring is provided to connect the first roller 281 and the second roller 282. Selectively, the elastic element can also be set to connect the two motors 38. The elastic element is set to adjust the distance between the first roller 281 and the second roller 282, and then adjust the pressing force between the at least one first carbon nanotube film structure 201 and the at least one second carbon nanotube film structure 202, and finally control the uniformity of the density of the first carbon nanotube paper and the second carbon nanotube paper.

Figure 5:
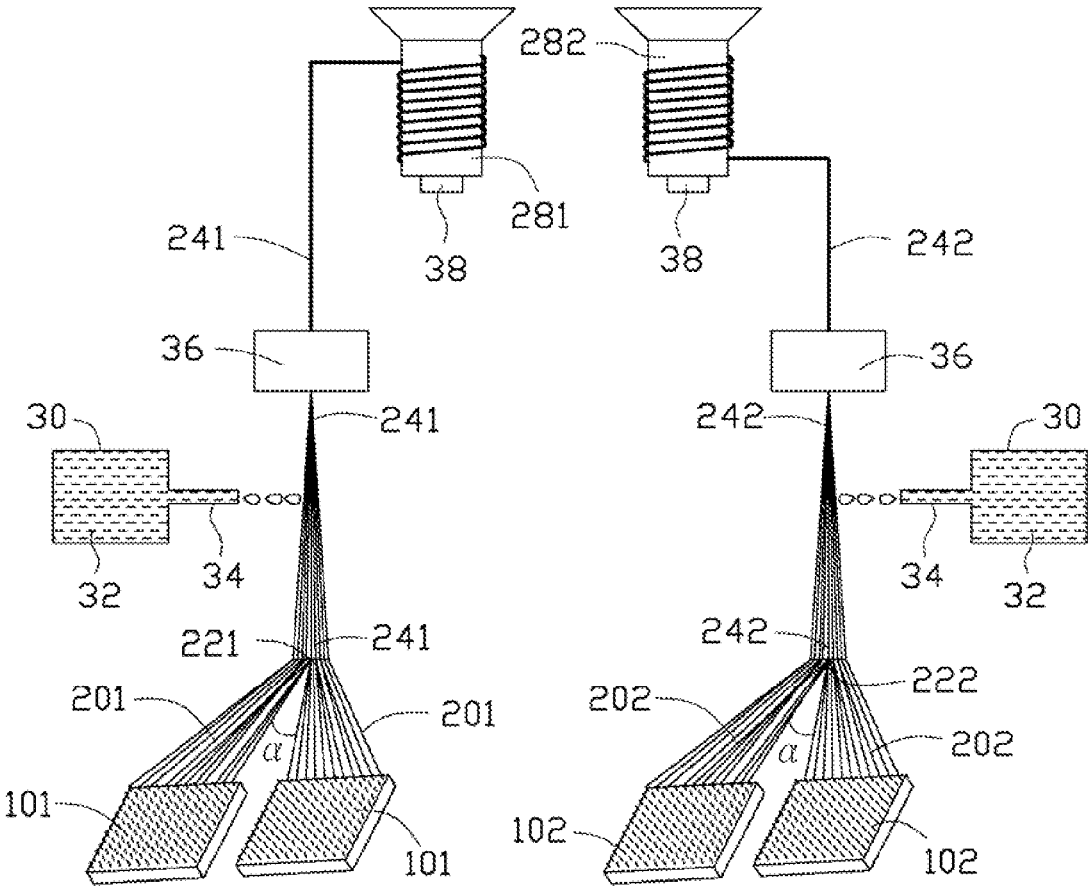
FIG. 5 is a schematic diagram of another method for making carbon nanotube paper according to one embodiment.

Referring to FIG. 5, in one embodiment, the at least one first carbon nanotube film structure 201 and the at least one second carbon nanotube film structure 202 can be treated with an organic solvent 32 to form a first carbon nanotube wire structure 241 and a second carbon nanotube wire structure 242 before they are wound onto the first roller 281 and the second roller 282. The first carbon nanotube wire structure 241 is obtained and treated by following steps:

(S1), forming the first carbon nanotube wire structure 241 by treating the at least one first carbon nanotube film structure 201 with the organic solvent 32;

(S2), drying the first carbon nanotube wire structure 241; and (S3), winding the first carbon nanotube wire structure 241 onto the first roller 281.

In step (S1), the organic solvent 32 can be dropped on the surface of the first carbon nanotube film structure 201 by a dropper 30. The dropper 30 includes an opening 34 in a bottom thereof. The organic solvent 32 can be dropped out from the opening 34 of the dropper 30, drop by drop. After being soaked by the organic solvent 32, the first carbon nanotube film structure 201 can be tightly shrunk, under a surface tension of the organic solvent, to the first carbon nanotube wire structure 241. The first carbon nanotube wire structure 241 includes a plurality of successively oriented carbon nanotubes joined end to end by van der Waals attractive force therebetween. The organic solvent 32 here can be any volatile fluid, such as ethanol, methanol, acetone, dichloroethane, and chloroform.

In step (S2), the first carbon nanotube wire structure 241 can be dried by passing through an oven 40 whose temperature is from about 80° C. to about 100° C. The first carbon nanotube wire structure 241 can also be dried by a air dryer the carbon nanotubes in the first carbon nanotube wire structure 241 are more tightly arranged than before the first carbon nanotube wire structure 241 is dried.

In step (S3), while the first carbon nanotube wire structure 241 is wound onto the first roller 281, the first carbon nanotube wire structure 241 arranges on the first roller 281 tightly and sequentially to form a film structure. During the winding process, the first carbon nanotube wire structure 241 should be wound onto the first roller 281 evenly. Therefore, the position of the first carbon nanotube wire structure 241 on the first roller 281 should be continuously changed during the winding process. In one embodiment, the first carbon nanotube wire structure 241 is moved and the first roller 281 is kept motionless along its axis to change the position of the first carbon nanotube wire structure 241 on the first roller 281 continuously. In another embodiment, the first roller 281 is moved along its axis and the first carbon nanotube wire structure 241 is kept motionless to change the position of the first carbon nanotube wire structure 241 on the first roller 281 continuously. The winding process can be executed by the motor 38 or by hand.

The second carbon nanotube wire structure 242 can be obtained and treated by a same method of the first carbon nanotube wire structure 241.

As the winding process continues, the first carbon nanotube wire structure 241 is evenly distributed on the first roller 281, and the second carbon nanotube wire structure 242 is evenly distributed on the second roller 282. Meanwhile, the thickness of the first carbon nanotube wire structure 241 on the first roller 281 and the thickness of the second carbon nanotube wire structure 242 on the second roller 282 become greater. Then, the distance between the first carbon nanotube wire structure 241 on the first roller 281 and the second carbon nanotube wire structure 242 on the second roller 282 becomes closer, and finally the first carbon nanotube wire structure 241 and the second carbon nanotube wire structure 242 closely contacts with each other. As the winding process continues, the first carbon nanotube wire structure 241 and the second carbon nanotube wire structure 242 begin to grind or press with each other. As the thickness of carbon nanotube wire structures on the rollers becomes thicker, the pressing or grinding force becomes stronger. Finally, the first carbon nanotube wire structure 241 and the second carbon nanotube wire structure 242 are both compacted. Thus, a high-density, oriented first carbon nanotube paper and a second carbon nanotube paper are obtained. In application, the first carbon nanotube paper and the second carbon nanotube paper can be sheared from the first roller 281 and the second roller 282, and cut into different size and shape to be applied in various devices.

Figure 6:
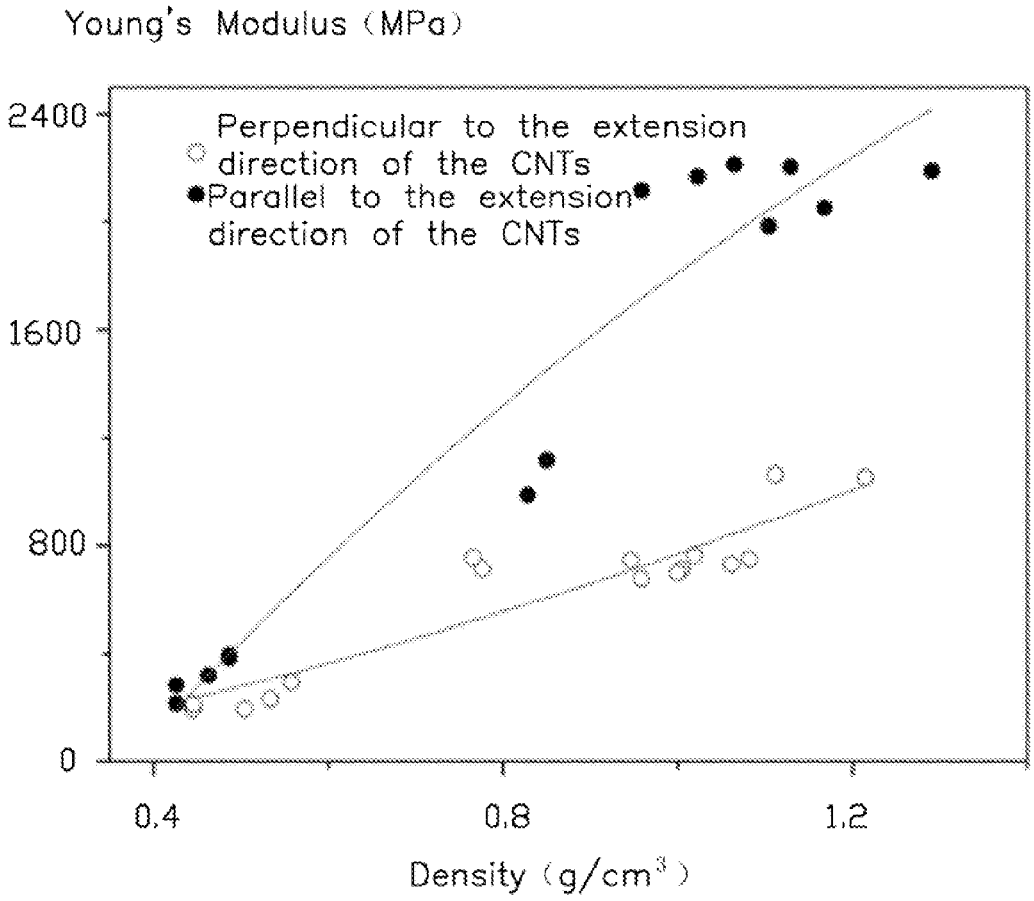
FIG. 6 is a graph showing a relationship between the Young's modulus and density of the carbon nanotube paper according to one embodiment.

FIG. 6 is a graph showing a relationship between the Young's modulus and density of the carbon nanotube paper according to one embodiment. The black dot in FIG. 6 refers to the Young's modulus of the carbon nanotube paper in a direction parallel to the extension direction of the majority of the carbon nanotubes in the carbon nanotube paper. The white dot in FIG. 6 refers to the Young's modulus of the carbon nanotube paper in a direction perpendicular to the extension direction of the majority of the carbon nanotubes in the carbon nanotube paper. It can be seen that, as the density of the carbon nanotube paper becomes higher, the Young's modulus of the carbon nanotube paper both in direction parallel to the extension direction of the carbon nanotubes and in direction perpendicular to the extension direction of the carbon nanotubes improve. Furthermore, the Young's modulus of the carbon nanotube paper in direction parallel to the extension direction of the carbon nanotubes improves faster than the Young's modulus of the carbon nanotube paper in direction perpendicular to the extension direction of the carbon nanotubes.

Figure 7:
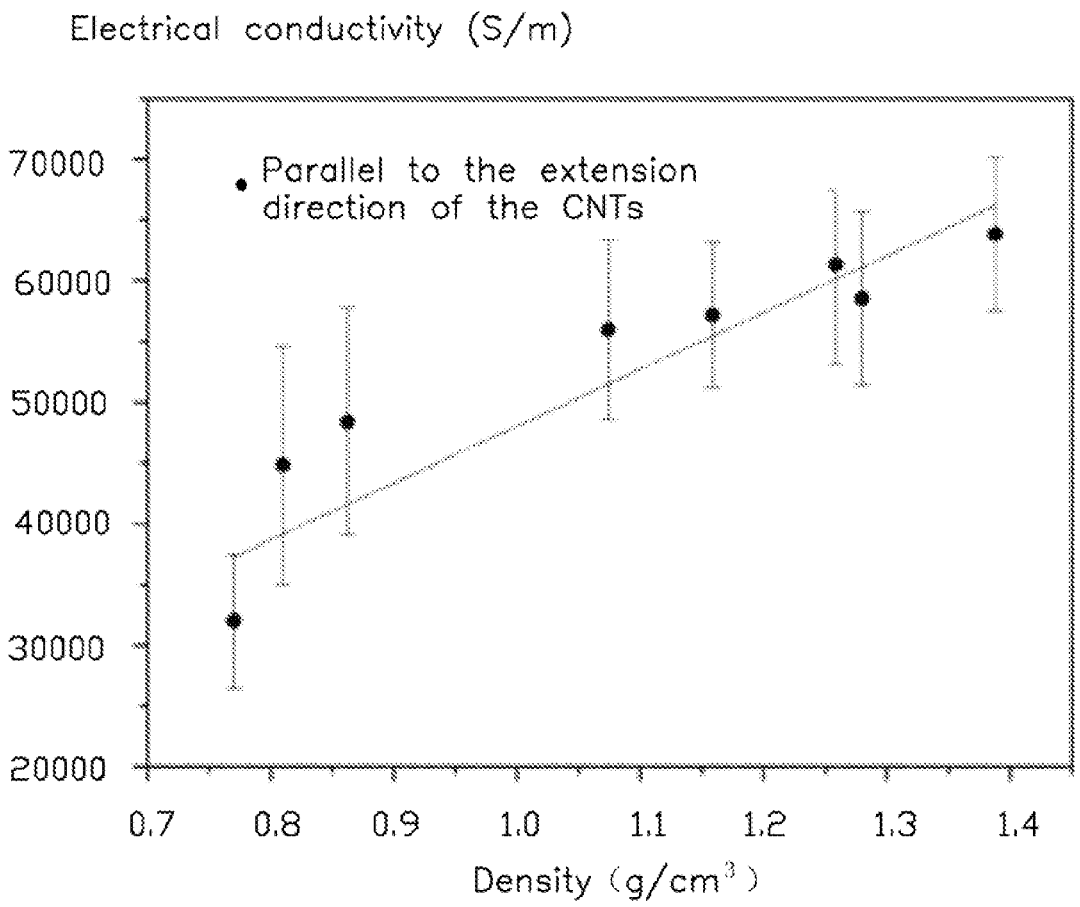
FIG. 7 is a graph showing a relationship between the electrical conductivity and density of the carbon nanotube paper according to one embodiment.

FIG. 7 is a graph showing a relationship between the electrical conductivity and density of the carbon nanotube paper according to one embodiment. The black dot in FIG. 7 refers to the electrical conductivity of the carbon nanotube paper in a direction parallel to the extension direction of the majority of the carbon nanotubes in the carbon nanotube paper. It can be seen that, as the density of the carbon nanotube paper becomes higher, the electrical conductivity of the carbon nanotube paper in direction parallel to the extension direction of the carbon nanotubes improves.

Figure 8:
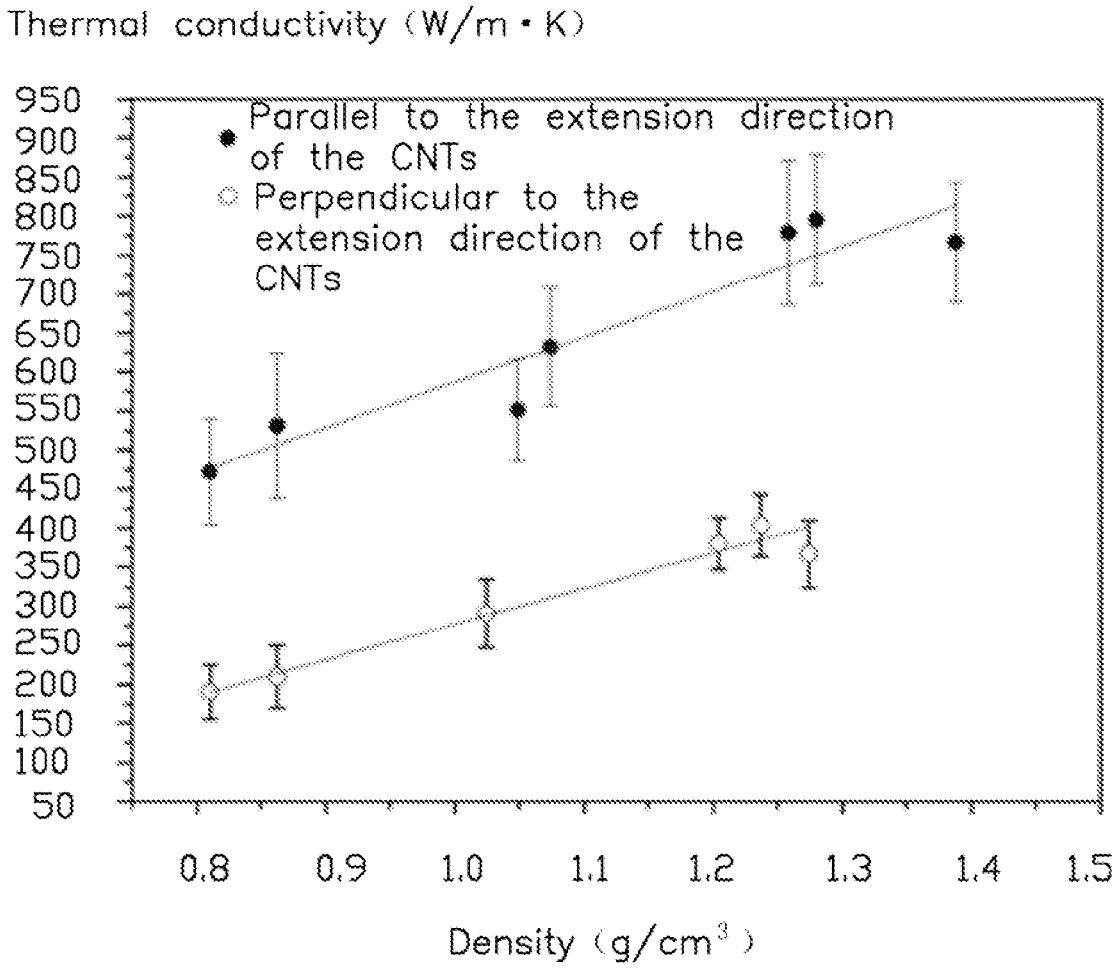
FIG. 8 is a graph showing a relationship between the thermal conductivity and density of the carbon nanotube paper according to one embodiment.

FIG. 8 is a graph showing a relationship between the thermal conductivity and density of the carbon nanotube paper according to one embodiment. The black dot in FIG. 8 refers to the thermal conductivity of the carbon nanotube paper in a direction parallel to the extension direction of the majority of the carbon nanotubes in the carbon nanotube paper. The white dot in FIG. 8 refers to the thermal conductivity of the carbon nanotube paper in a direction perpendicular to the extension direction of the majority of the carbon nanotubes in the carbon nanotube paper. It can be seen that, as the density of the carbon nanotube paper becomes higher, the thermal conductivity of the carbon nanotube paper both in direction parallel to the extension direction of the carbon nanotubes and in direction perpendicular to the extension direction of the carbon nanotubes improve.

Figure 9:
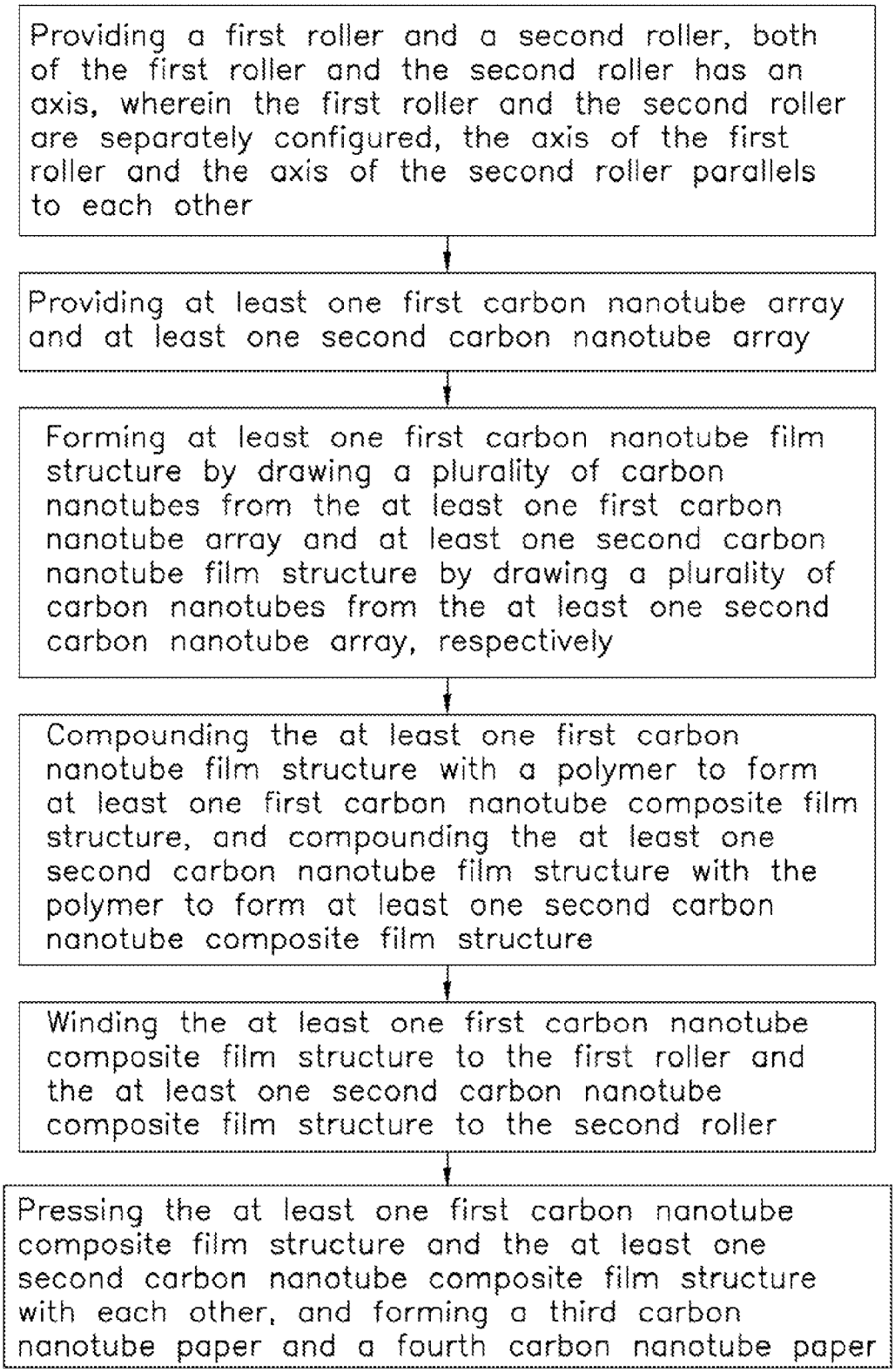
FIG. 9 is a flowchart of a method for making carbon nanotube paper according to another embodiment.
Figure 10:
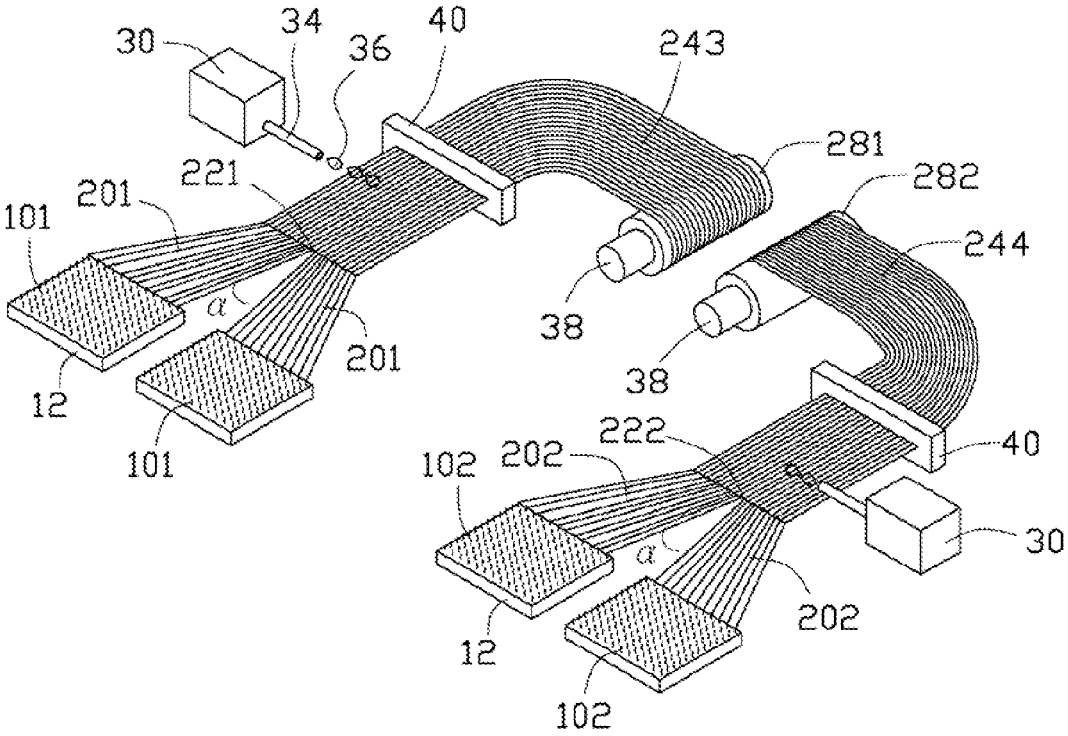
FIG. 10 is a schematic diagram of a method for making carbon nanotube paper according to another embodiment.

Referring to FIG. 9 and FIG. 10, another embodiment of a method for making a carbon nanotube paper includes following steps:

(S1), providing a first roller 281 and a second roller 282, wherein each of the first roller 281 and the second roller 282 has an axis, the first roller 281 and the second roller 282 are separately configured, the axis of the first roller 281 and the axis of the second roller 282 are parallel to each other;

(S2), providing at least one first carbon nanotube array 101 and at least one second carbon nanotube array 102;

(S3), forming at least one first carbon nanotube film structure 201 by drawing a plurality of carbon nanotubes from the at least one first carbon nanotube array 101 and forming at least one second carbon nanotube film structure 202 by drawing a plurality of carbon nanotubes from the at least one second carbon nanotube array 102;

(S4), compounding the at least one first carbon nanotube film structure 201 with a polymer 36 to form at least one first carbon nanotube composite film structure 243, and compounding the at least one second carbon nanotube film structure 202 with the polymer 36 to form at least one second carbon nanotube composite film structure 244;

(S5), winding the at least one first carbon nanotube composite film structure 243 to the first roller 281 and winding the at least one second carbon nanotube composite film structure 244 to the second roller 282; and (S6), pressing the at least one first carbon nanotube composite film structure 243 and the at least one second carbon nanotube composite film structure 244 with each other, and forming a first carbon nanotube paper and a second carbon nanotube paper.

In step (S4), the polymer 36 can be a melting polymer or a polymer solution. The polymer solution includes a polymer 36 and a volatile organic solvent. The polymer 36 can be Phenolic resin, Epoxy resin, Polyurethane, Polystyrene, PMMA, Polycarbonate, PET, Phenylpropanoid cyclobutene, Polycyclic olefin or Polyaniline. The volatile organic solvent can be ethanol, methanol, acetone, dichloroethane, or chloroform.

In step (S4), the compounding method can be vacuum evaporating the polymer 36, ion sputtering the polymer 36, or dropping the polymer solution with the dropper 30. In one embodiment, the compounding method includes following steps:

(S41), setting the dropper 30 upon the at least one first carbon nanotube film structure 201 and the at least one second carbon nanotube film structure 202;

(S42), dropping the polymer 36 solution from the opening 34 of the dropper 30 to the at least one first carbon nanotube film structure 201 and the at least one second carbon nanotube film structure 202; and (S43), forming the at least one first carbon nanotube composite film structure 243 and the at least one second carbon nanotube composite film structure 244.

Selectively, the at least one first carbon nanotube composite film structure 243 and the at least one second carbon nanotube composite film structure 244 can be dried by passing through the oven 40 whose temperature is from about 80° C. to about 100° C. in a further process. The at least one first carbon nanotube composite film structure 243 and the at least one second carbon nanotube composite film structure 244 can also be dried by an air dryer. The carbon nanotubes in the at least one first carbon nanotube composite film structure 243 and the at least one second carbon nanotube composite film structure 244 are more tightly arranged after removing the volatile organic solvent.

It can be understood that, before winding to the rollers, the at least one first carbon nanotube composite film structure 243 and the at least one second carbon nanotube composite film structure 244 can be treated with the organic solvent 32 to form a first carbon nanotube composite wire structure and a second carbon nanotube composite wire structure.

Figure 11:
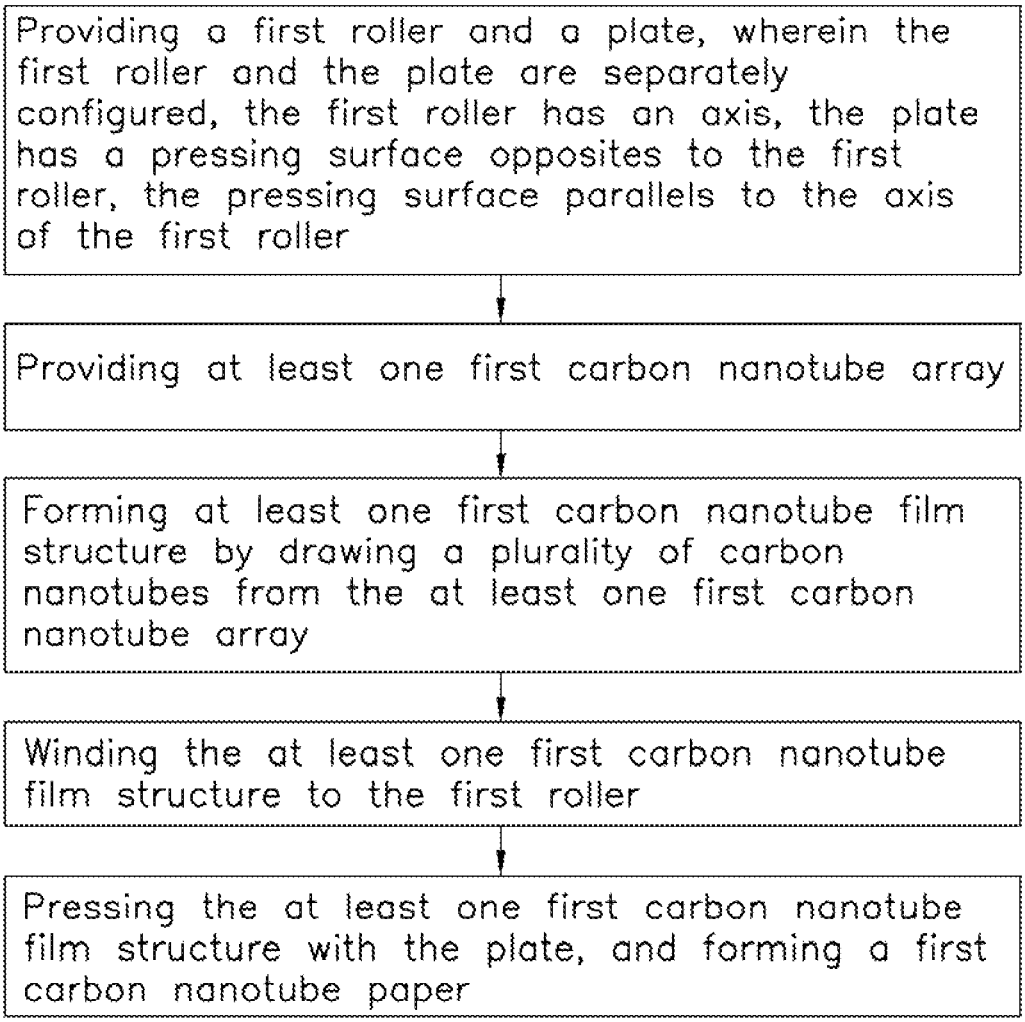
FIG. 11 is a flowchart of a method for making carbon nanotube paper according to another embodiment.
Figure 12:
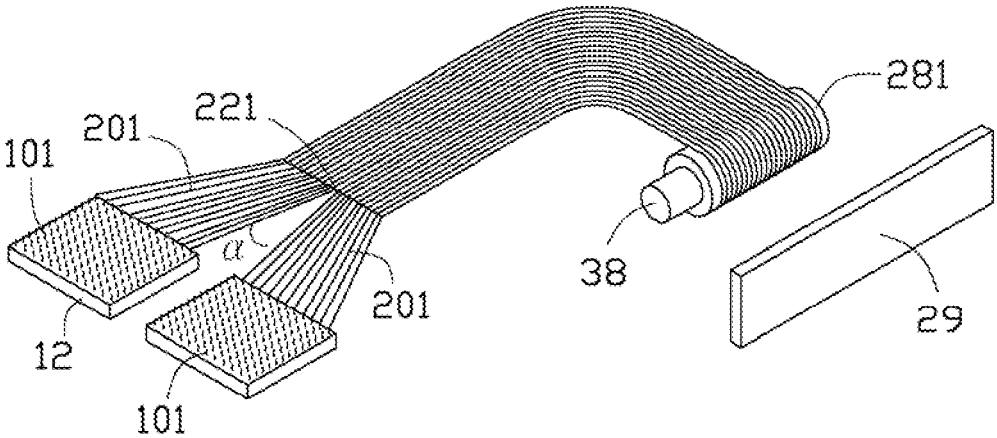
FIG. 12 is a schematic diagram of a method for making carbon nanotube paper according to another embodiment.

Referring to FIG. 11 and FIG. 12, another embodiment of a method for making a carbon nanotube paper includes following steps:

(S1), providing a first roller 281 and a pressing device 29, wherein the first roller 281 and the pressing device 29 are separately configured, the first roller 281 has an axis, the pressing device 29 has a pressing surface opposing the first roller 281;

(S2), providing at least one first carbon nanotube array 101;

(S3), forming at least one first carbon nanotube film structure 201 by drawing a plurality of carbon nanotubes from the at least one first carbon nanotube array 101;

(S4), winding the at least one first carbon nanotube film structure 201 to the first roller 281; and (S5), pressing the at least one first carbon nanotube film structure 201 with the pressing device 29, and forming a first carbon nanotube paper.

In step (S1), the pressing surface of the pressing device 29 can be parallel to the axis of the first roller 281 in one embodiment. The material of the pressing device 29 can be metals such as steel, iron, and copper. It can also be non-metals such as organic glass, silicon and quartz. The pressing surface of the pressing device 29 can be a plane surface or a curved surface. In one embodiment, the pressing device 29 is an organic glass plate with a plane surface. In another embodiment, the pressing device 29 is a roller. The distance between the first roller 281 and the pressing device 29 can range from about 30 microns to about 130 microns.

In step (S4), as the winding process continues, the at least one first carbon nanotube film structure 201 on the first roller 281 accumulates layer by layer. Thus, the distance between the at least one first carbon nanotube film structure 201 on the first roller 281 and the pressing device 29 becomes closer and finally they contact with each other.

In step (S5), as the winding process continues, the pressing device 29 grinds or presses the at least one first carbon nanotube film structure 201. As the thickness of the at least one first carbon nanotube film structure 201 on the first roller 281 becomes thicker, the pressing or grinding force becomes stronger. Finally, the at least one first carbon nanotube film structure 201 is compacted. Thus, a high-density, oriented first carbon nanotube paper is obtained.

Figure 13:
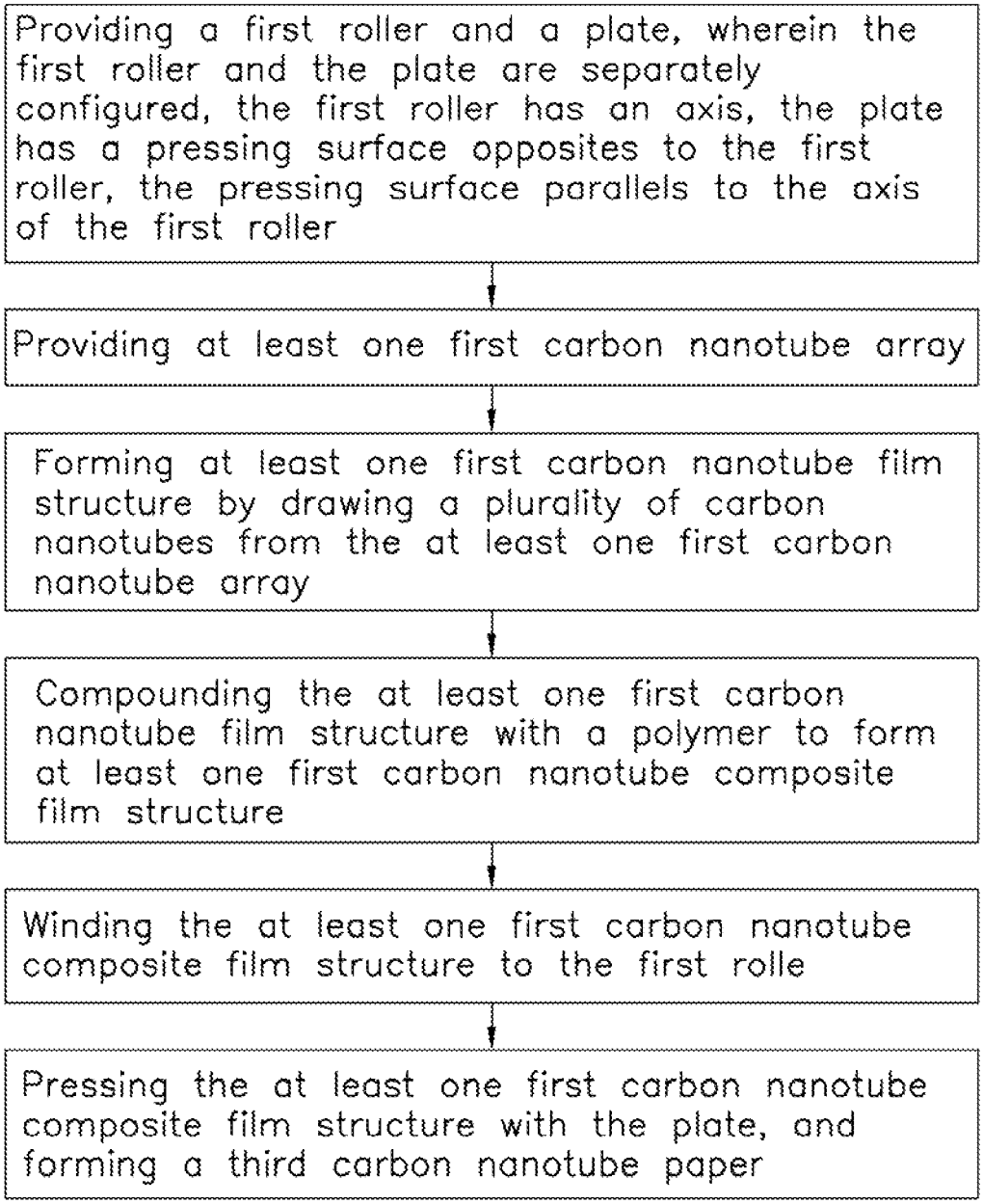
FIG. 13 is a flowchart of a method for making carbon nanotube paper according to another embodiment.
Figure 14:
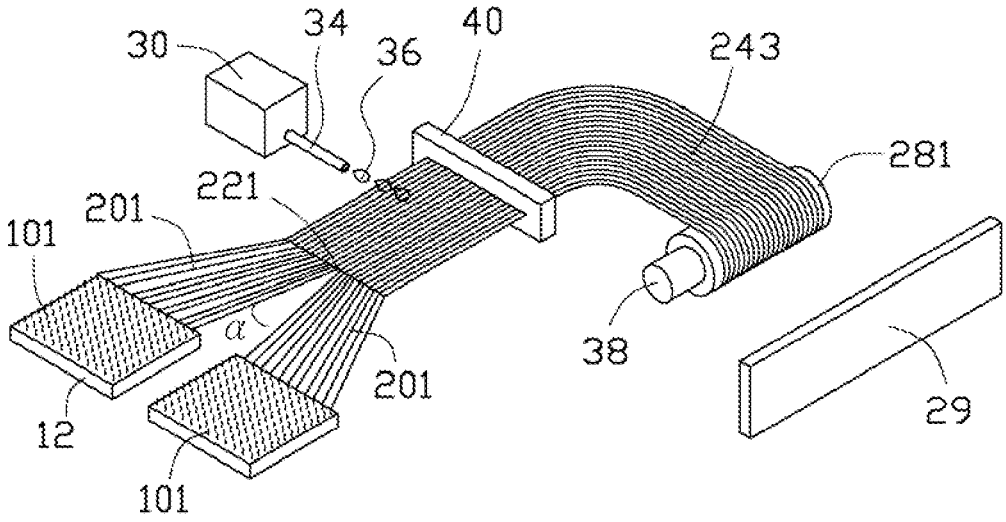
FIG. 14 is a schematic diagram of a method for making carbon nanotube paper according to another embodiment.

Referring to FIG. 13 and FIG. 14, another embodiment of a method for making a carbon nanotube paper includes following steps:

(S1), providing a first roller 281 and a pressing device 29, wherein the first roller 281 and the pressing device 29 are separately configured, the first roller 281 has an axis, the pressing device 29 has a pressing surface opposing the first roller 281;

(S2), providing at least one first carbon nanotube array 101;

(S3), forming at least one first carbon nanotube film structure 201 by drawing a plurality of carbon nanotubes from the at least one first carbon nanotube array 101;

(S4), compounding the at least one first carbon nanotube film structure 201 with a polymer 36 to form at least one first carbon nanotube composite film structure 243;

(S5), winding the at least one first carbon nanotube composite film structure 243 to the first roller 281; and (S6), pressing the at least one first carbon nanotube composite film structure 243 with the pressing device 29, and forming a first carbon nanotube paper.

The pressing surface of the pressing device 29 can be parallel to the axis of the first roller 281 in one embodiment. The pressing surface of the pressing device 29 can be a plane surface or a curved surface. The pressing device 29 is a plate in one embodiment. The pressing device 29 is a roller in another embodiment.

Selectively, the at least one first carbon nanotube composite film structure 243 formed in step (S4) can be dried by passing through the oven 40 whose temperature is from about 80° C. to about 100° C. in a further process. The at least one first carbon nanotube composite film structure 243 can also be dried by an air dryer. The carbon nanotubes in the at least one first carbon nanotube composite film structure 243 are more tightly arranged after removing the volatile organic solvent than before the at least one first carbon nanotube composite film structure 243 is dried.

The methods for making carbon nanotube paper and the carbon nanotube paper made by the methods in this disclosure have advantages as follows: (a) the carbon nanotubes in the carbon nanotube paper have good orientation due to the carbon nanotube film structure is drawn from the carbon nanotube array; (b) the density of carbon nanotube paper is relatively high, so the mechanical property, electrical conductivity and thermal conductivity of the carbon nanotube paper are also improved; (c) the carbon nanotube paper may be applied as a dissipation structure in various electronic products; (d) the carbon nanotube paper can be produced successively and automatically.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

It is also to be understood that the above description and the claims drawn to a method may include some indication in reference to certain steps. However, the indication used is only to be viewed for identification purposes and not as a suggestion as to an order for the steps.

What is claimed is:

1. A method for making a carbon nanotube paper, the method comprising:

(a) providing at least one carbon nanotube film structure, a roller, and a pressing device;

(b) winding the at least one carbon nanotube film structure onto the roller; and (c) pressing the at least one carbon nanotube film structure on the roller with the pressing device, thereby forming a carbon nanotube paper on the roller.

2. The method as claimed in claim 1, further comprising (d) compounding the at least one carbon nanotube film structure with a polymer to form at least one carbon nanotube composite film structure before (b).

3. The method as claimed in claim 1, further comprising (e) treating the at least one carbon nanotube film structure with an organic solvent to form a carbon nanotube wire structure before (b).

4. The method as claimed in claim 3, further comprising (f) drying the carbon nanotube wire structure after (e).

5. The method as claimed in claim 1, wherein (b) further comprises:

(b1) contacting the at least one carbon nanotube film structure to the roller;

(b2) winding the at least one carbon nanotube film structure to the roller;

(b3) spinning the roller to wind the at least one carbon nanotube film structure to the roller.

6. The method as claimed in claim 1, wherein the carbon nanotube film structure is obtained by a method comprising:

(s1) providing at least one carbon nanotube array;

(s2) providing a drawing tool;

(s3) contacting the drawing tool to a plurality of carbon nanotubes of the at least one carbon nanotube array; and (s4) drawing the plurality of carbon nanotubes by the drawing tool along a drawing direction.

7. The method as claimed in claim 1, wherein the roller has an axis, the pressing device has a pressing surface opposing the roller, the pressing surface are parallel to the axis of the roller.

8. The method as claimed in claim 1, wherein there is a distance between the roller and the pressing device, and the distance ranges from about 30 microns to about 130 microns.

9. The method as claimed in claim 1, wherein there is an elastic element connecting to the roller and the pressing device.

10. The method as claimed in claim 1, wherein the pressing device is a plate with a plane surface.

11. The method as claimed in claim 1, wherein the pressing device is a roller.

12. The method as claimed in claim 1, wherein the at least one carbon nanotube film structure is compacted after pressing so that a density of the first carbon nanotube paper ranges from about 0.3 $g/cm^3$ to about 1.4 $g/cm^3$.

13. A method for making a carbon nanotube paper, the method comprising:

(a) providing at least one first carbon nanotube film structure, at least one second carbon nanotube film structure, a first roller and a second roller;

(b) winding the at least one first carbon nanotube film structure onto the first roller and winding the at least one second carbon nanotube film structure onto the second roller; and (c) pressing the at least one first carbon nanotube film structure and the at least one second carbon nanotube film structure with each other, and forming a first carbon nanotube paper on the first roller and a second carbon nanotube paper on the second roller.

14. The method as claimed in claim 13, further comprising (d) compounding the at least one first carbon nanotube film structure with a polymer to form at least one first carbon nanotube composite film structure and compounding the at least one second nanotube film structure with the polymer to form at least one second carbon nanotube composite film structure before (b).

15. The method as claimed in claim 13, further comprising (e) treating the at least one first carbon nanotube film structure with an organic solvent to form at least one first carbon nanotube wire structure and treating the at least one second carbon nanotube film structure with the organic solvent to form at least one second carbon nanotube wire structure before (b).

16. The method as claimed in claim 15, further comprising (f) drying the first carbon nanotube wire structure and the second carbon nanotube wire structure after (e).

17. The method as claimed in claim 13, wherein each of the first roller and the second roller has an axis, the first roller and the second roller are separately configured, the axis of the first roller and the axis of the second roller are parallel to each other.

18. The method as claimed in claim 17, wherein there is a distance between the first roller and the second roller, and the distance between the first roller and the second roller ranges from about 30 microns to about 130 microns.

19. The method as claimed in claim 13, wherein there is a pressing force between the at least one first carbon nanotube film structure and the at least one second carbon nanotube film structure when pressing with each other, and the pressing force ranges from about 20 MPa to about 40 MPa.

20. A method for making a carbon nanotube paper, the method comprising:

(a) providing at least one first carbon nanotube film structure, at least one second carbon nanotube film structure, a first roller and a second roller;

(b) treating the at least one first carbon nanotube film structure with an organic solvent to form at least one first carbon nanotube wire structure and treating the at least one second carbon nanotube film structure with the organic solvent to form at least one second carbon nanotube wire structure;

(c) drying the at least one first carbon nanotube wire structure and the at least one second carbon nanotube wire structure;

(d) winding the at least one first carbon nanotube wire structure onto the first roller evenly and winding the at least one second carbon nanotube wire structure onto the second roller evenly; and (e) pressing the at least one first carbon nanotube wire structure and the at least one second carbon nanotube wire structure with each other, and forming a first carbon nanotube paper on the first roller and a second carbon nanotube paper on the second roller.

* * * * *